US005171938A

United States Patent [19]

Katsumata et al.

[11] Patent Number: 5,171,938

[45] Date of Patent: Dec. 15, 1992

[54] ELECTROMAGNETIC WAVE FAULT PREVENTION CABLE

[75] Inventors: Makoto Katsumata; Akira Ikegaya; Hidenori Yamanashi; Hitoshi Ushijima, all of Shizuoka, Japan

[73] Assignee: Yazaki Corporation, Tokyo, Japan

[21] Appl. No.: 686,554

[22] Filed: Apr. 17, 1991

[30] Foreign Application Priority Data

Apr. 20, 1990 [JP] Japan ..... 2-103155
Apr. 20, 1990 [JP] Japan ..... 2-103156
Apr. 20, 1990 [JP] Japan ..... 2-103157

[51] Int. Cl.[5] ..... H01B 7/34

[52] U.S. Cl. ..... 174/36; 174/105 SC; 174/117 F; 174/117 FF

[58] Field of Search ..... 174/36, 102 SC, 105 SC, 174/117 F, 117 FF

[56] References Cited

U.S. PATENT DOCUMENTS

| | | | |
|---|---|---|---|
| 3,096,210 | 7/1963 | Boonstra | 174/120 SC |
| 3,433,687 | 3/1969 | Price | 156/47 |
| 3,707,595 | 12/1972 | Plate | 174/115 |
| 4,059,724 | 11/1977 | Ide | 174/36 |
| 4,317,001 | 2/1982 | Silver et al. | 174/102 SC |
| 4,371,745 | 2/1983 | Sakashita | 174/115 |
| 4,486,252 | 12/1984 | Lloyd | 174/36 X |
| 4,564,723 | 1/1986 | Lang | 174/36 |
| 4,626,618 | 12/1986 | Takaoka et al. | 174/102 SC X |
| 4,800,236 | 1/1989 | Lemke | 174/36 |
| 4,816,616 | 3/1989 | Jones | 174/36 X |
| 4,845,311 | 7/1989 | Schreiber et al. | 174/36 |
| 4,871,883 | 10/1989 | Guiol | 174/36 |
| 4,923,637 | 5/1990 | Yagi et al. | |
| 4,966,412 | 10/1990 | Lai et al. | 174/107 |
| 4,998,090 | 3/1991 | Park | 174/102 SC X |

FOREIGN PATENT DOCUMENTS

| | | | |
|---|---|---|---|
| 0279985 | 8/1988 | European Pat. Off. | |
| 2139848 | 8/1973 | Fed. Rep. of Germany | |
| 2654486A1 | 6/1978 | Fed. Rep. of Germany | |
| 47-12580 | 5/1972 | Japan | |
| 52-39738 | 9/1977 | Japan | |
| 53-48998 | 11/1978 | Japan | |
| 56-43567 | 10/1981 | Japan | |
| 60-16004 | 5/1985 | Japan | |
| 60-42415 | 12/1985 | Japan | |
| 61-133510 | 6/1986 | Japan | |
| 64-38909 | 2/1989 | Japan | |
| 1-243305 | 9/1989 | Japan | |
| 8202627 | 1/1984 | Netherlands | 174/36 |
| 1549150 | 7/1979 | United Kingdom | |
| 2047947 | 12/1980 | United Kingdom | 174/36 |

*Primary Examiner*—Morris H. Nimmo
*Attorney, Agent, or Firm*—Sughrue, Mion, Zinn, Macpeak & Seas

[57] ABSTRACT

A shield wire comprising: a conductor, an insulation layer provided around an outer periphery of the conductor; an electrically-conductive resin layer provided around an outer periphery of the insulation layer; a covering insulation layer formed around an outer periphery of the electrically-conductive resin layer; and shield device for shielding the shield cable from electromagnetic interference, the means formed to electrically contact the electrically-conductive resin layer.

18 Claims, 9 Drawing Sheets

ELECTROMAGNETIC WAVE FAULT PREVENTION CABLE

BACKGROUND OF THE INVENTION

This invention relates to an electromagnetic interference prevention cable. More specifically, a high-frequency interference prevention and/or electromagnetic wave induction prevention wire is used for electrical connection of an electronic device such as an audio device and an office automatic device.

In conventional electromagnetic and high-frequency circuits, various kinds of shield cables and shield plates have been used in order to prevent a wrong operation due to noises produced from such circuit.

In the conventional high-frequency interference prevention, a static coupling and an electromagnetic coupling between the wires is interrupted by a shield cable or a shield plate, thereby removing unnecessary oscillation.

However, such method requires a highly-technical layout of shield cables and shield plates, and can not actually be achieved easily.

In recent years, a computer control for electric devices and electric products has been remarkable. Electronic circuits of such devices have been highly integrated, and current flowing through elements have been microscopic, and there has arisen a problem that a wrong operation of the device may occur due to induction between wires of a wiring bundle.

On the other hand, the products have become compact and lightweight, and also the space-saving and lightweight design of the wiring has been strongly desired.

There is known a shield cable of this kind as shown in FIG. 11 in which an insulation layer 102, a shield layer 104 and a covering insulation layer 105 are provided around an outer periphery of a central conductor 101, and a drain wire 103 is provided along the shield layer 104 so as to facilitate an earth connection operation (Japanese Utility Model Application Examined Publication No. Sho. 53-48998). The shield layer 104 is made of electrically conductive metal such as a metal braid and a metal foil.

In the conventional shield cable with the drain wire, a wire (conductor) of a circular cross-section is used as the drain wire 103, and therefore the diameter of the shield cable becomes large. This has prevented a small-size and space-saving design.

In the case where an electrically-conductive resin is used as the shield layer 104, anisotropy is encountered when the drain wire 103 is provided parallel to the conductor 101 in the conventional manner. The result is that a uniform shielding effect can not be obtained.

There is also disclosed a shield cable having no drain wire and utilizing an electrically-conductive resin. However, since high electrical conductivity can not be obtained, a practical use of it is difficult. Therefore, a metal braid or a metal foil is in practical use. However, the metal braid need to have a high braid density, and therefore tends to be heavy and expensive. The metal foil lacks in flexibility, and becomes deteriorated due to corrosion, thus failing to provide sufficient durability. Thus, these problems have been encountered.

Also, there are commercially available shield cables in which a metal foil, a metal braid or an electrically-conductive resin is provided, as an electrically-conductive layer, around a conductor insulator or a bundle of wires (Japanese Patent Application Unexamined Publication No. Sho. 64-38909). However, each of all the wires is formed into a shield wire, the wiring bundle has much space loss because of the circular cross-section of the wire. Thus, it is not suited for the space-saving purpose. Further, for connecting the electrically-conductive layer to the earth, a manual operation is required for separating the electrically-conductive layer from the internal conductor, and therefore the wiring can not be automated. Further, in the type of shield cable in which an electrically-conductive layer is provided around a bundle of several wires, induction between the wires within the bundle can not be prevented. When a metal foil or a metal braid is used as a shield layer, the construction is complicated, and therefore the efficiency of production of the cable is low, and a high cost is involved.

On the other hand, recently, in order to achieve the space-saving of the wiring, tape-like cables have been increasingly used, and there have been marketed a shield cable in which such a tape cable is enclosed by a metal foil or a metal braid as described above. Even with this wire, induction within the tape cable can not be prevented (Japanese Patent Application Unexamined Publication No. Sho. 61-133510/86).

Further, in the two, the type which uses metal as the shield electrically-conductive layer has a problem that it is heavy and inferior in durability.

SUMMARY OF THE INVENTION

With the above problems in view, it is an object of This invention to provided a high-frequency interference prevention wire designed to be used in a high-frequency circuit and in the presence of electromagnetic wave, in which eliminates resonance due to interference between wires without the need for any high layout technique, thereby preventing a wrong operation of the circuit.

A second object of the invention is to provide a shield cable with a drain wire, which exhibits a uniform shield effect with respect to the direction of electromagnetic wave, and has a lightweight, compact and inexpensive construction.

A third object of the invention is to provide a inter-conductor induction prevention tape cable which is lightweight, corrosion-resistant, excellent in production efficiency, inexpensive, and space-saving.

According to a first aspect of the present invention, there is provided a high-frequency interference prevention cable characterized in that an electrically-conductive resin layer having a volume resistivity of $10^{-3}$ to $10^{5}$ Ω·cm is provided between a conductor and a covering insulation layer. According to a second aspect of the invention, there is provided a shield cable with a drain wire wherein an insulation layer, an electrically-conductive resin layer and a covering insulation layer are sequentially provided around an outer periphery of a conductor; and a drain wire is provided in contiguous relation to the electrically-conductive resin layer; characterized in that: the drain wire is provided spirally in such a manner that the drain wire is either embedded in the electrically-conductive resin layer or disposed in contact with the electrically-conductive resin layer.

Preferably, the electrically-conductive resin has a volume resistivity of $10^{-3}$ to $10^{4}$ Ω·cm so as to have a high electrical conductivity.

At least one drain wire is spirally wound at a rate of not more than 200 turns per meter, or provided in parallel relation or intersecting relation to one another.

In order to reduce the diameter of the shield cable, the ratio of the cross-sectional area (S1) of the electrically-conductive resin layer to the cross-sectional area (S2) of the drain wire is represented by $S1/S2<1500$. Preferably, the drain wire has a flattened ribbon-like shape.

According to a third aspect of the invention, there is provided an induction prevention tape cable comprising a plurality of parallel conductors electrically insulated from one another, characterized in that an induction prevention member composed of an electrically-conductive resin having a volume resistivity of $10^{-3}$ to $10^4$ Ω·cm is provided between any two adjacent ones of the conductors.

Preferably, the induction prevention member is not only provided between any adjacent conductors electrically insulated from one another, but also covers each conductor over the whole or part of the periphery of each conductor. Preferably, a drain wire is provided in such a manner that the drain wire is disposed in electrical contact partially or entirely with the induction prevention member so as to provide a shield effect against electromagnetic wave.

BRIEF DESCRIPTION OF THE DRAWINGS

FIGS. 7(*b*), 7(*c*), 7(*d*) are views of a drain wire provided in accordance with the present invention;

DESCRIPTION OF THE PREFERRED EMBODIMENTS OF THE INVENTION

The invention will now be described in detail with reference to the drawings.

Figure 1:
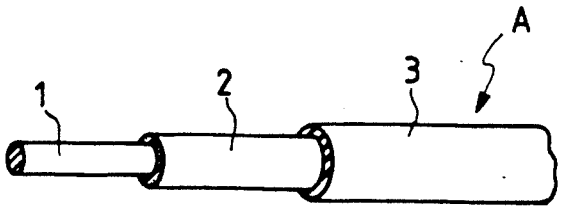
FIGS. 1 and 2 are perspective views of high-frequency interference prevention cables of the present invention, respectively.

FIG. 1 shows a high-frequency interference prevention cable A in which an electrically-conductive resin layer 2 is provided around an outer periphery of a conductor 1, and a covering insulation layer 3 is provided around the layer 2.

Figure 2:
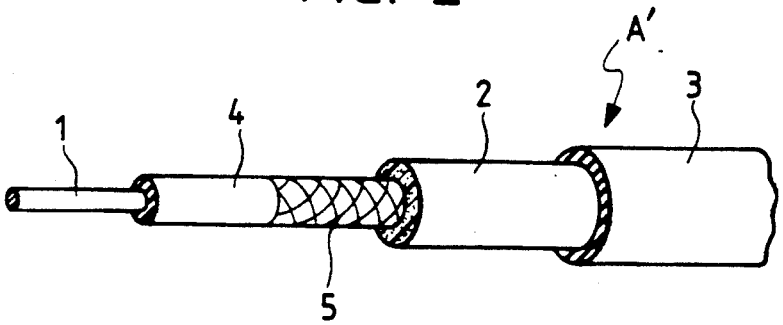

In a high-frequency interference prevention cable A' shown in FIG. 2, an inner insulation layer 4 and a shield layer 5 composed of a metal braid (or metal foil) are provided between a conductor 1 and an electrically-conductive resin layer 2. The shield layer 5 functions to prevent an electromagnetic wave induction.

The electrically-conductive resin layer 2 is made of an electrically-conductive resin having a volume resistivity of $10^{-3}$ $10^5$ Ω·cm, and preferably $10^{-3}$ to $10^2$ Ω·cm.

The compositions of a matrix, an electrical conductivity-imparting material and the other additives of this electrically-conductive resin are not particularly limited. For example, as the matrix, there can be used a thermoplastic resin such as PE, PP, EVA and PVC, a thermosetting resin such as an epoxy or a phenolic resin, rubber such as silicone rubber, EPDM, CR and fluororubber, or a styrene-type or an olefin-type thermoplastic elastomer or ultraviolet curing resin. One or more of metal powder, metal fiber, carbon black, PAN-type carbon fiber, pitch-type carbon fiber, vapor phase-growing carbon fiber, graphitized carbon fiber and metal-plated one of these carbon fibers is combined, as the electrical conductivity-imparting material, with the matrix to produce the electrically-conductive resin having a desired volume resistivity. Additives such as a process aid, a filler and a reinforcing agent can be added.

For example, for producing the electrically-conductive resin, 20 to 160 parts by weight of graphitized vapor phase-growing fiber, pulverized into a length of 0.1 to 50 μm, is added to 100 parts by weight of ethylene vinyl acetate resin constituting the matrix, and these are kneaded by a blender such as a pressure kneader, a Henschel mixer and a double-screw mixer, and according to an ordinary procedure, the mixture is extrusion-molded to produce a highly electrically conductive resin having a volume resistivity of $10^3$ to $10^{-3}$ Ω·cm.

The electrically-conductive resin thus obtained is coated onto the conductor 1 or the shield layer 5 (FIG. 2) by a known method such as extrusion. By doing so, advantageous effects of the present invention can be obtained.

Figure 5:
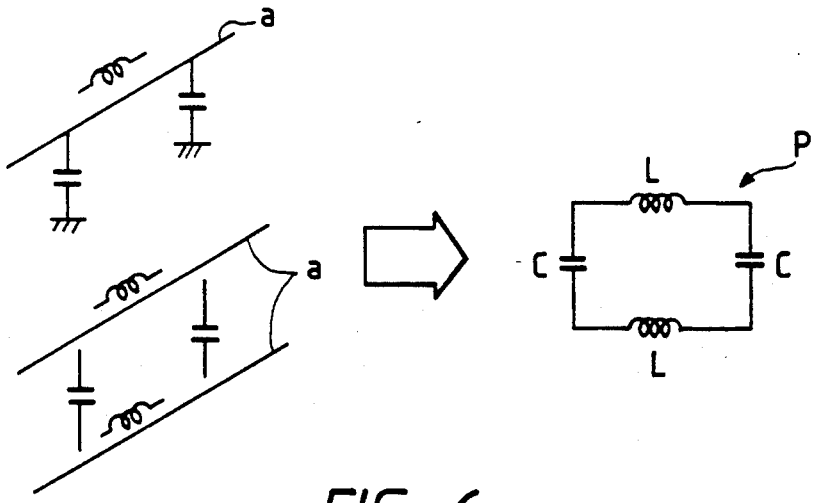
FIG. 5 PRIOR ART
FIG. 5 is a view showing principle of the operation of a conventional cable.

FIG. 5 shows an electric loop P produced when using a conventional cable In order to eliminate this loop, various layouts have been tried as described above. In this Figure, reference character L denotes a reactance of a wire, and reference numeral C denotes a capacitance between the wires and a capacitance between the wire and the earth.

Figure 6:
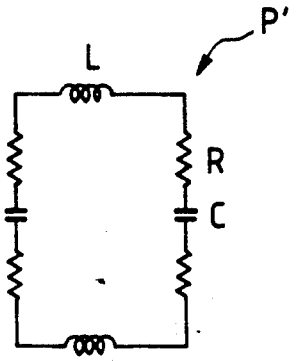
FIG. 6 is as view showing principle of the operation of the cable of the present invention.
Figure 7A:
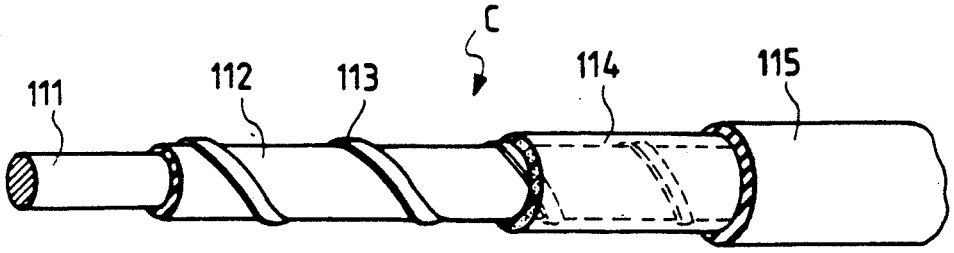
FIG. 7(*a*) is a perspective view of a shield cable with a drain wire provided in accordance with the present invention.
Figure 7B:
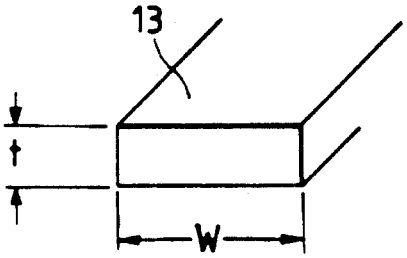
Figure 7C:
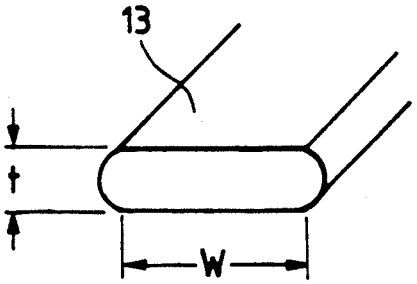
Figure 7D:
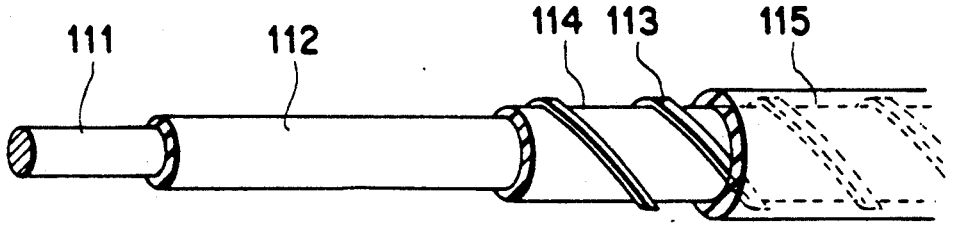

FIG. 6 shows an electric loop P' obtained when using the cable of the present invention having the electrically-conductive resin layer with a volume resistivity of $10^{-3}$ to $10^5$ Ω·cm. R (resistor) is inserted in the closed loop, so that the circuit current is attenuated, thereby reducing the resonance.

Thus, in the high-frequency interference prevention cable of the present invention, R is naturally inserted in the electric loop (resonance circuit) produced when using the conventional cable. Therefore, the resonance du to the wiring in the high-frequency circuit as well as the leakage of the high frequency is prevented.

For preventing the electromagnetic induction, the shield layer is provided on the cable, as described above.

Comparative Example 1

An ordinary wire, having a copper conductor (whose cross-sectional area was 0.5 $mm^2$) and an insulation coating (polyvinyl chloride) (whose outer diameter was 1.6 mm) coated on the conductor, was used as a standard sample. EXAMPLE 1

An electrically-conductive resin having a volume resistivity of $10^0$ Ω·cm was coated on a copper conductor (whose cross-sectional area was 0.5 $mm^2$) to form a 0.4 mm-thick resin coating thereon. Then, PVC was coated on the resin coating to form thereon a PVC layer 2.4 mm in outer diameter, thereby preparing a high-frequency interference prevention wire (measuring sample) as shown in FIG. 1.

Figure 3:
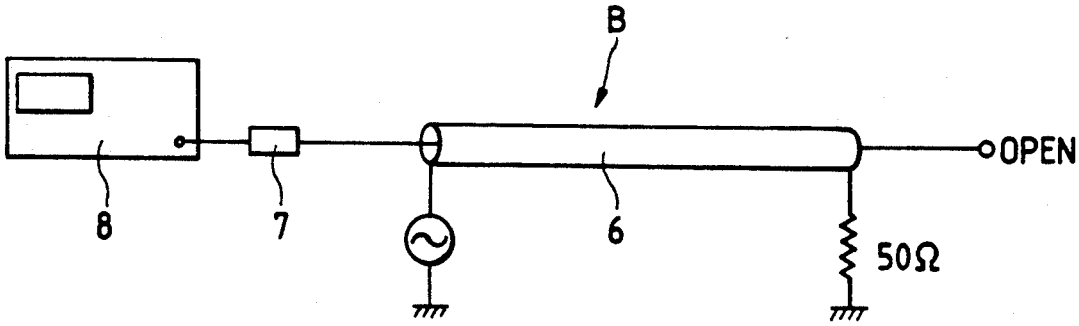
FIG. 3 is a view showing a device for measuring an interference prevention effect of the above cables.

The above standard sample and the above measuring sample were separately set in a central portion of a copper pipe 6 (inner diameter: 10 mm; length: 100 cm) of a measuring device B shown in FIG. 3, and a high-frequency interference prevention effect (interference with the copper pipe) was measured. In this Figure, reference numeral 7 denotes FET probe, and reference numeral 8 denotes a spectrum analyzer.

Referring to the measuring method, in the above device B, the components of the frequency, produced in the sample by induction when electric field was applied to the copper pipe, were analyzed by the spectrum analyzer. The standard sample with no shield was first measured, and then the measuring sample was set in the device, and one end of the shield layer layer was grounded, and the measuring sample was measured.

Figure 4:
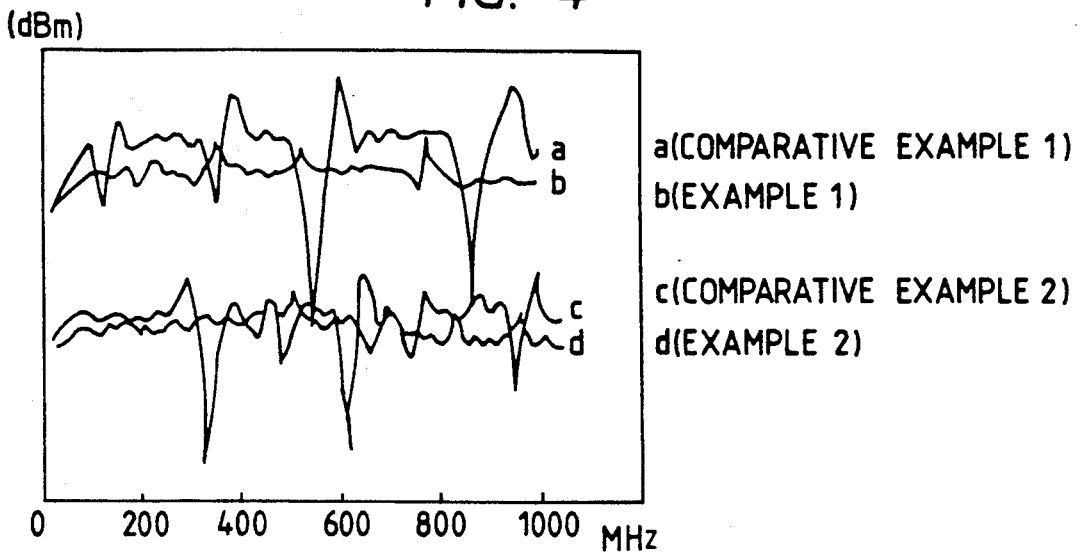
FIG. 4 is a graph showing high-frequency interference prevention characteristics of Examples 1 and 2 and Comparative Examples 1 and 2.

The measurement results of the two cables are indicated respectively by a curve a (Comparative Example 1) and a curve b (Example 1) in FIG. 4.

COMPARATIVE EXAMPLE 2

An insulation coating (PVC) having an outer diameter of 1.6 ϕmm was formed on a copper conductor having a cross-sectional area of 0.5 $mm^2$, and a metal braid was provided on the insulation coating to form a shield structure (outer diameter 2.1 ϕmm) thereon. Then, a covering insulation layer (PVC) was formed on the shield structure to prepare a shield cable having an outer diameter of 2.9 ϕmm.

EXAMPLE 2

An electrically-conductive resin was coated on the shield braid of Comparative Example 2 to form thereon an electrically-conductive resin layer having a thickness of 0.4 mm and a volume resistivity of $10^0$ Ω·cm, thereby preparing a high-frequency interference prevention cable as shown in FIG. 2.

A high-frequency interference prevention effect was measured with respect to the above two cables in the same manner as described above. The results thereof are indicated by a curve c (Comparative Example 2) and a curve d (Example 2) in FIG. 4.

As is clear from FIG. 4, with respect to Comparative Example 1 (curve a), the cable resonated with the copper pipe, and a large interference due to induction is recognized. However, with respect to Example 1 (curve b), it will be appreciated that this interference is greatly reduced.

Similarly, in Comparative Example 2 (curve c), better electromagnetic wave induction prevention effect than that of Comparative Example 1 (curve a) is obtained, but the cable resonated with the copper pipe, and a large interference is recognized. In Example 2 (curve d), the interference is greatly reduced.

As described above, by using the high-frequency interference prevention cable of the present invention, the interference due to the resonance in the high-frequency circuit can be prevented, and the use of the conventional shield plate and the difficulty of the layout are omitted, thereby achieving the space-saving.

Further, by the addition of the shield layer, the electromagnetic wave induction can be prevented at the same time, thereby eliminating a wrong operation of the circuit.

A second embodiment of the invention will now be described in detail.

FIG. 7(*a*) shows a shield cable C according to the present invention with a drain wire in which an insulation layer 112 is coated on a conductor 111 of copper, and a drain wire 113 is spirally wound around this insulation layer at a rate of ten turns per meter, and further an electrically-conductive resin layer 114 is coated, and a covering insulation layer 115 is provided for insulating purposes.

Preferably, the drain wire 113 is turned at least twice per meter. In the illustrated embodiment, although the drain wire 113 is wound on the outer periphery of the insulation layer 112, that is, disposed inwardly of the electrically-conductive resin layer 114, the drain wire may be wound around the outer periphery of the electrically-conductive resin layer 114 in so far as the former is in contact with the latter as shown in FIG. 7(*d*). Also, the drain wire may be embedded in the inner surface of the electrically-conductive resin layer 114.

As shown in FIGS. 7(*b*) and 7(*c*), it is preferred that a ribbon-like metal conductor of a flattened cross-section (hereinafter referred to as "flattened square conductor") be used as the drain wire 113. This flattened square conductor can be subjected to plating. The ratio of the width W to the thickness t of the flattened square conductor is preferably not less than 1, and more preferably not less than 10. Alternatively, a flattened braid formed by braiding narrow conductors into a ribbon-like configuration can be used.

With respect to the relation between the cross-sectional area (S2) of the drain wire 113 and the cross-sectional area (S1) of the electrically-conductive resin layer 114, it is preferred that $S1/S2<1500$ be established. In so far as this requirement is satisfied, either a single wire or a plurality of wires can be used. In the case of the plurality of wires, the wires can be wound in parallel to each other, or in intersecting relation.

The electrically-conductive resin layer 114 is made of an electrically-conductive resin having a volume resistivity of not more than $10^4$ Ω·cm.

The compositions of a matrix, an electrical conductivity-imparting material and the other additives of this electrically-conductive resin are not particularly limited. For example, as the matrix, there can be used a thermoplastic resin such as PE, PP, EVA and PVC, a thermosetting resin such as an epoxy or a phenolic resin, rubber such as silicone rubber, EPDM, CR and fluororubber, or a styrene-type or an olefin-type thermoplastic elastomer or ultraviolet curing resin. One or more of metal powder, metal fiber, carbon black, PAN-type carbon fiber, pitch-type carbon fiber, vapor phase-growing carbon fiber, and graphitized or metal-plated one of these carbon fibers is combined, as the electrical conductivity-imparting material, with the matrix to produce the electrically-conductive resin having a desired volume resistivity. Additives such as a process aid, a filler and a reinforcing agent can be added.

For example, for producing the electrically-conductive resin, 20 to 160 parts by weight of graphitized vapor phase-growing fiber, pulverized into a length of 0.1 to 50 um, is added to 100 parts by weight of ethylene vinyl acetate resin constituting the matrix, and these are kneaded by a blender such as a pressure kneader, a Henschel mixer and a double-screw mixer, and according to an ordinary procedure, the mixture is extrusion-molded to produce a highly electrically conductive resin having a volume resistivity of $10^{-3}$ to $10^{3}$ Ω·cm.

In the shield cable with the drain wire according to the present invention, the drain wire is wound on the inner or the outer surface of the electrically-conductive resin layer, and is disposed in contact therewith. Anisotropy due to the shield effect is overcome.

Despite the fact that there is used the electrically-conductive resin layer having a volume resistivity of $10^{4}$ to $10^{-2}$ Ω·cm, excellent shield characteristics can be obtained, and as compared with the conventional metal braid and the metal foil, the cable can be lightweight and be produced at lower costs, and deterioration due to corrosion is eliminated, thereby enhancing the durability and reliability.

Further, by the use of the flattened drain wire, the diameter of the shield cable can be reduced, and by spirally winding the drain wire, excellent shield effects can be obtained up to a high-frequency region.

EXAMPLE 3

A flattened square conductor, composed of a copper conductor (1.5 mm×0.1 mm) subjected to plating (tinning: 1 μm thickness), was spirally wound at a rate of ten turns per meter on a wire (outer diameter: 1.1 mm) composed of a copper conductor (whose cross-sectional area was 0.3 $mm^2$) coated with PVC. Then, an electrically-conductive resin (volume resistivity: $10^{0}$ Ω·cm), containing a vapor phase-growing carbon fiber as an electrical conductivity-imparting material, was coated thereon to form thereon an electrically-conductive resin layer having a thickness of 0.5 mm. Then, a covering insulation layer was provided on the electrically-conductive resin layer to prepare a shield cable with the drain wire.

Figure 8:
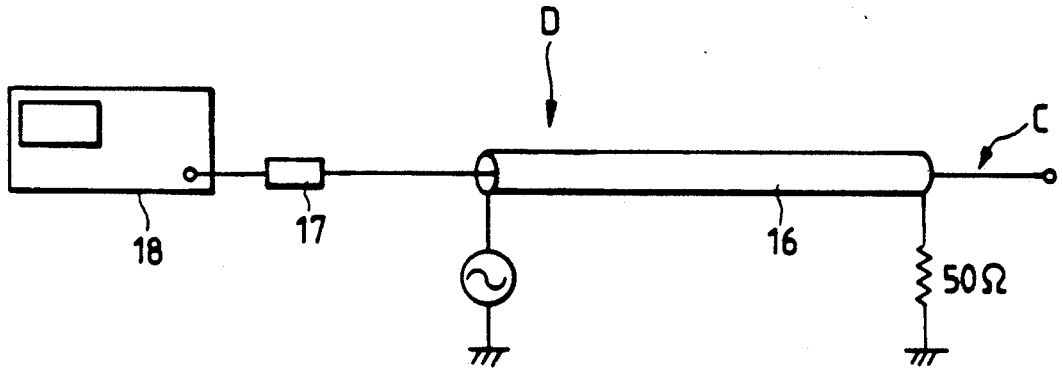
FIG. 8 is a view showing a device for measuring a shield effect of the above shield cable.

This shield cable was placed in an eccentric manner in a copper pipe 116 (inner diameter: 10 ϕmm; length: 100 cm) of a measuring device D of FIG. 8, and the anisotropy of the shield effect was confirmed. In FIG. 8, reference numeral 117 denotes FET probe, and reference numeral 118 denotes a spectrum analyzer.

Referring to the measuring method, induced voltage (Vo) induced in the cable when applying electric field to the copper pipe was measured, and then induced voltage (Vm) induced in the cable when connecting the drain wire to the ground was measured. The initial attenuation amount at each frequency was determined by the following formula:

$$S = 20 \log \frac{Vo}{Vm}$$

where S represents the shield effect, Vo represents the initial induced voltage, and Vm represents the induced voltage after the shielding.

Figure 10:
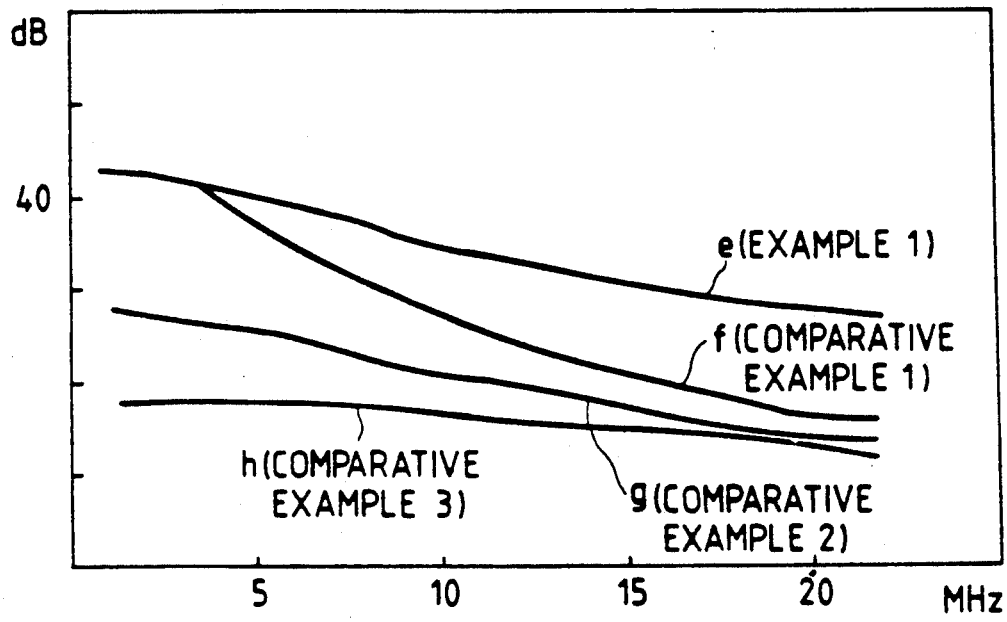
FIG. 10 is a graph showing shield characteristics of Example 3 and Comparative Examples 3 and 4, respectively.

The measurement results are indicated by a curve e in FIG. 10.

COMPARATIVE EXAMPLES 3 to 5

Figure 11:
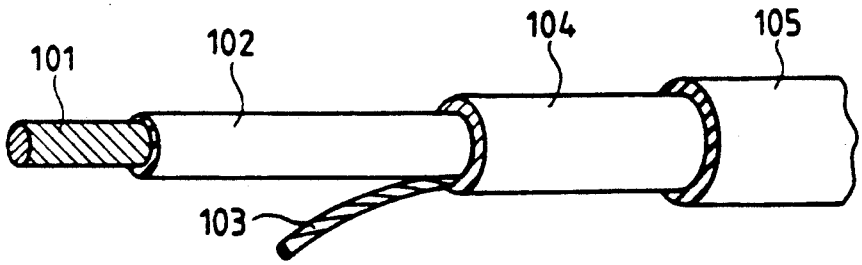
FIG. 11 PRIOR ART
FIG. 11 is a perspective view of the prior art.

A copper conductor (drain wire) having an cross-sectional area of 0.3 $mm^2$ was extended along and parallel to a wire (outer diameter: 1.1 mm) composed of a copper conductor (whose cross-sectional area was 0.3 $mm^2$) coated with PVC (see FIG. 11). Then, an electrically-conductive resin (volume resistivity: $10^{0}$ Ω·cm), containing a vapor phase-growing carbon fiber as an electrical conductivity-imparting material, was coated thereon to form thereon an electrically-conductive resin layer having a thickness of 0.5 mm. Then, a covering insulation layer was provided on the electrically-conductive resin layer to prepare a shield cable C' with the drain wire.

Figure 9A:
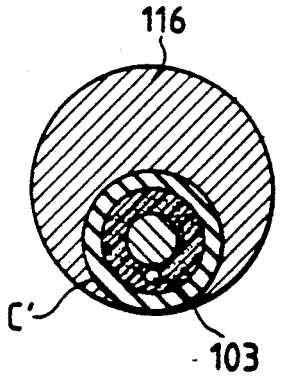
FIGS. 9(*a*) and 9(*b*) are views showing the manner of setting the shield cable in the above device.
Figure 9B:
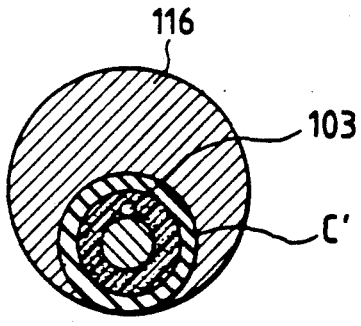

The shield wire C' was placed at the bottom of the copper pipe 116 with the drain wire 103 being eccentric to the lower side (Comparative Example 3) as shown in FIG. 9(*a*). Also, the shield wire C' was placed at the bottom of the copper pipe 116 with the drain wire 103 being eccentric to the upper side (Comparative Example 4) as shown in FIG. 9(*b*). In the same manner as described above for Example 3, the anisotropy of the shield effect was measured.

The results thereof are indicated by curves f and g in FIG. 10.

Also, there was prepared a cable with a drain wire of Comparative Example 5 which differed from the cable of Example 3 in that instead of the electrically-conductive resin having a volume resistivity of $10^{0}$ Ω·cm, an electrically-conductive resin having a volume resistivity of $10^{5}$ Ω·cm was used. The measurement results of this cable was indicated by a curve h in FIG. 10.

As is clear from FIG. 10, the anisotropy was recognized in the curves f and g representing the cables each having the parallel drain wire; however, the anisotropy was not recognized in the curve e (Example 3) representing the cable having the spirally-wound drain wire, and the cable represented by the curve exhibited far better shield effect at high frequency than the cable represented by the curve h.

As described above, the shield cable with the drain wire according to the present invention does not exhibit anisotropy, and has excellent shield effect up to high-frequency regions, and with the use of the flattened drain wire, the diameter of the cable can be reduced.

Further, since the electrically-conductive resin having a volume resistivity of $10^{-3}$ to $10^{4}$ Ω·cm is used as the shield layer, excellent processability can be achieved, and the lightweight and compact design can be achieved, and the shield effect generally equal to that achieved by a metal braid can be achieved.

A third embodiment of the present invention will now be described.

Figure 12:
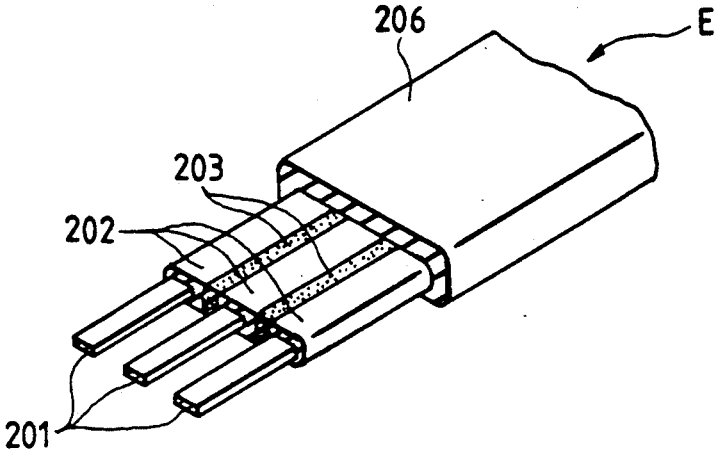
FIGS. 12 to 17 are perspective views of induction prevention tape cables of the present invention, respectively.

FIG. 12 shows an induction prevention tape cable (hereinafter referred to merely as "cable") E in which an induction prevention member 203 is provided between any adjacent ones of a plurality of conductors 201, each coated with an insulator 202, to isolate the conductors 201 from one another, and a covering insulation member 206 is provided to cover the induction prevention member 203.

The induction prevention member 203 is made of an electrically-conductive resin having a volume resistivity of $10^{-3}$ to $10^{4}$ Ω·cm, and preferably $10^{-3}$ to $10^{0}$ cm.

The electrically-conductive resin is obtained by adding an electrical conductivity-imparting material to a matrix resin. This electrical conductivity-imparting material comprises one or more of metal powder, metal particles, metal flakes, metal fiber, electrically-conductive carbon black, graphite powder, PAN-type carbon fiber, pitch-type carbon fiber, vapor phase-growing carbon fiber, and graphitized one of these carbon fibers. According to a procedure for the production of an ordinary tape cable, as the matrix resin, there can be used a thermoplastic resin such as PVC, EVA, EEA, PE, PP, PET and PBT, a paint thereof, an epoxy-type or phenolic-type thermosetting resin, a paint thereof, rubber such as silicone rubber, EPDM, and fluororubber, or ultraviolet curing resin, and a suitable combination of these materials can also be used.

For example, for producing the electrically-conductive resin, 20 to 160 parts by weight of graphitized vapor phase-growing fiber, pulverized into a length of 0.1 to 50 um, is added to 100 parts by weight of ethylene vinyl acetate resin constituting the matrix, and these are kneaded into pellet form by a blender such as a pressure kneader, a Henschel mixer and a double-screw mixer, and according to an ordinary procedure, the mixture is extrusion-molded to produce a highly electrically conductive resin having a volume resistivity of $10^{-3}$ to $10^{3}$ Ω·cm.

Figure 13:
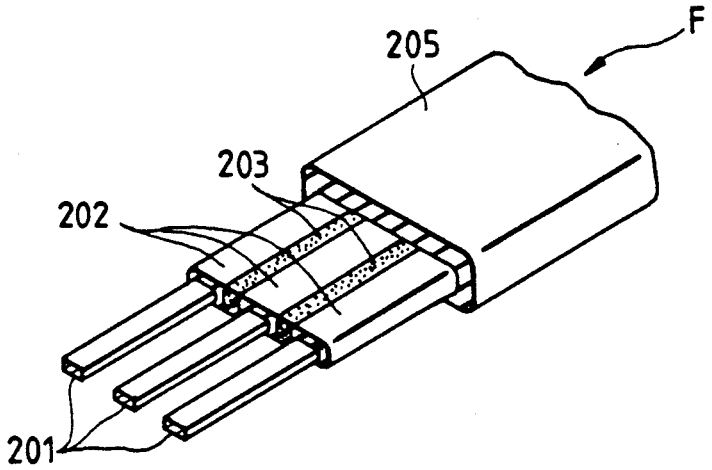

A cable F shown in FIG. 13 differs from the cable E of FIG. 12 in that a metal foil 205 covers the covering insulation member 206.

Figure 14:
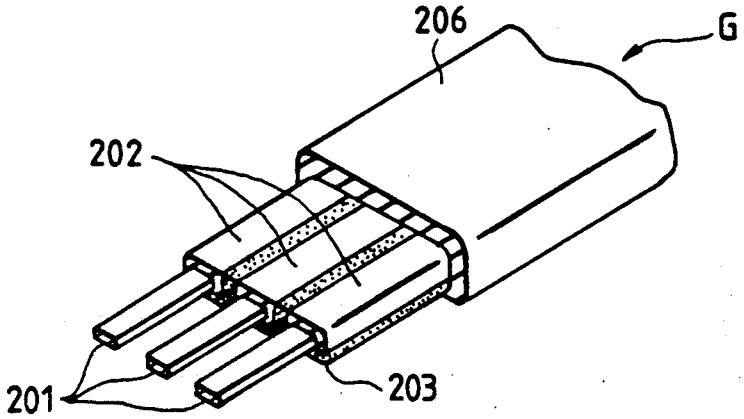

A cable G shown in FIG. 14 differs from the cable E of FIG. 12 in that the induction prevention member 203 is also provided on the lower surfaces of the insulated conductors 201 disposed parallel to one another.

Figure 15:
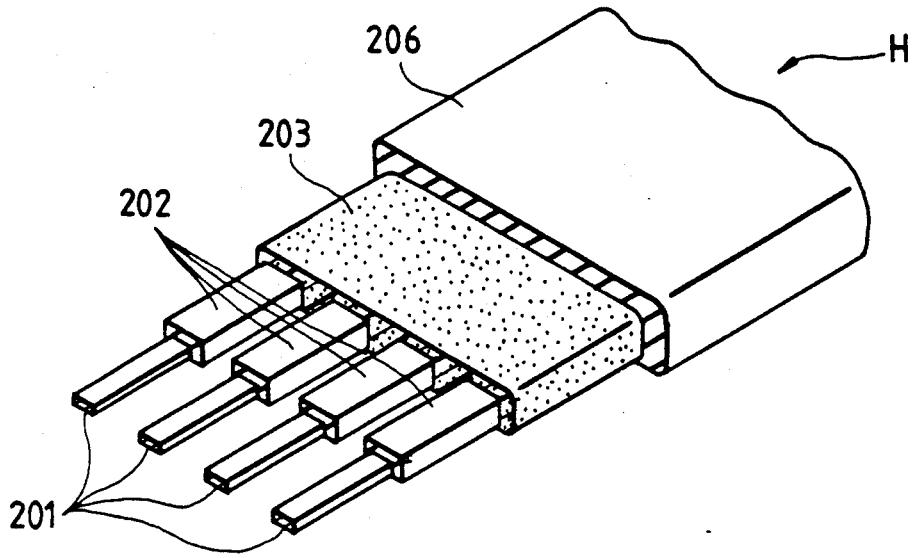

A cable H shown in FIG. 15 differs from the cable E of FIG. 12 in that the induction prevention member 203 is provided around the entire outer periphery of each conductor 201.

Figure 16:
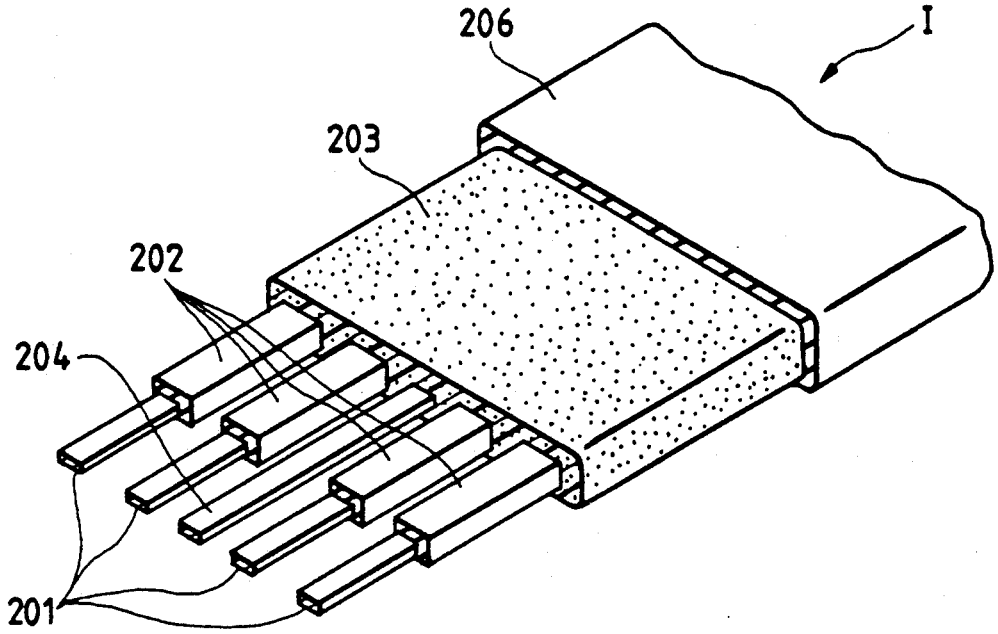

A cable I shown in FIG. 16 differs from the cable H of FIG. 15 in that a drain wire 204 is disposed between two conductors 201 and is embedded in the induction prevention member 203.

The drain wire 204 is composed of a metal conductor such as a single wire, a plurality of wires, a flattened conductor and a flattened square conductor. It is preferred that the drain wire 204 be disposed parallel to the conductor 201 partially (preferably, entirely) in electrical contact with the induction prevention member 203. To obtain a uniform shield effect with respect to each conductor, it is preferred that the drain wire 204 be disposed at the central portion of the cable I.

Figure 17:
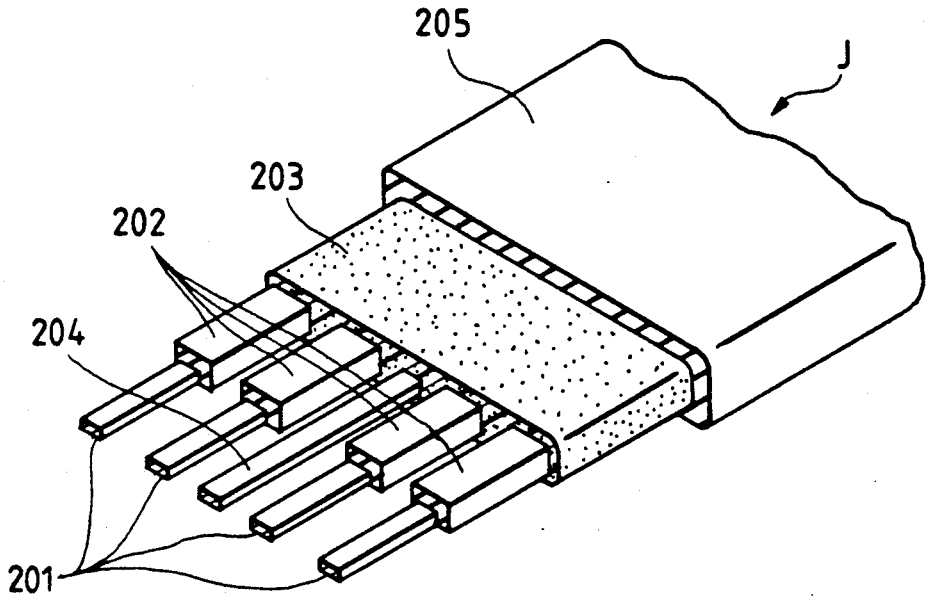

A cable J shown in FIG. 17 differs from the cable I of FIG. 16 in that a metal foil 205 covers the entire periphery of the induction prevention member 203. Preferably, to improve wear resistance, the covering insulation member (not shown) is provided as in the cable I.

In FIGS. 13 and 17, the metal foil 205 is a shield layer, and it may be replaced by a metal mesh or a metal braid.

In the induction prevention tape cables of the present invention, the induction prevention member composed of the electrically-conductive resin is provided between the adjacent conductors, and therefore the inter-conductor induction within the tape cable can be prevented.

Figure 21:
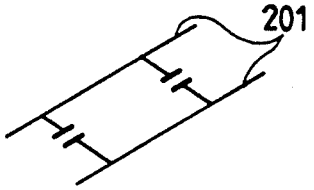
FIG. 21 is a illustration showing the principles of the operation of a conventional product.
Figure 22:
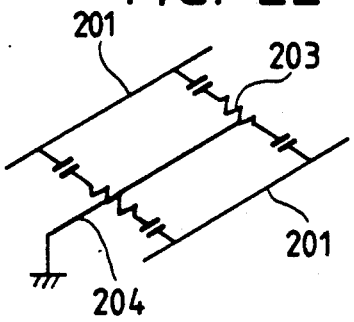
FIG. 22 is a illustration showing the principles of the operation of the product of the present invention.

More specifically, FIGS. 21 and 22 show the principles of operation of a conventional product and a product of the present invention, respectively. In FIG. 21, the induction prevention member 203 is not provided between two conductors 201 and 201. In FIG. 22, the induction prevention member 203 is provided between two conductors 201 and 201. Reference numeral 204 denotes the drain wire connected to the prevention member 203, and reference numeral L denotes a inter-conductor capacity.

Since the induction prevention member is made of the electrically-conductive resin, it is provided between the adjacent conductor with no gap, and the thickness of the cable can be reduced. If the electrical conductivity-imparting material of the electrically-conductive resin is of the carbon type, the cable is lightweight, and excellent corrosion resistance is achieved.

By the use of the drain wire 204 electrically connected to the electrically-conductive resin, the connection to the earth can be easily made.

EXAMPLES

With respect to the cables of FIGS. 12, 15 and 17, a tinned hard copper material of a flattened square shape (thickness: 0.15 mm; width: 1.5 mm; plating thickness: not less than 1 μm) was used as the conductor 201. An enamel paint was coated on each conductor to form thereon the inner insulator 202 having a thickness of 0.05 mm. An electrically-conductive resin, which was composed of EVA and graphitized vapor phase-growing carbon fiber and was adjusted to a volume resistivity of $2\times10^{-1}$ Ω≠cm, was used as the induction prevention member 203. In this manner, the various cables E, H, I and J were prepared. In the cables E and H, a polyester film having a thickness of 0.1 mm was used as the covering insulation member 206, and a Cu foil having a thickness of 0.05 mm was used as the metal foil 205.

Figure 18:
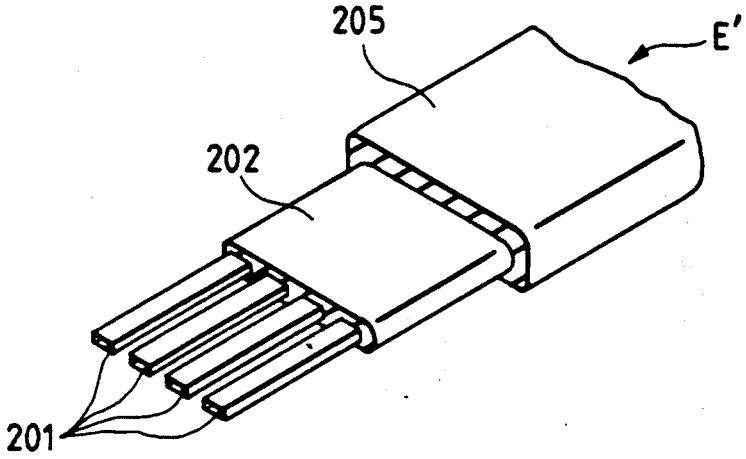
FIG. 18 is a perspective view of a tape cable for comparative purposes.

As Comparative Example shown in FIG. 18, there was prepared a tape cable E' similar in construction to the cable E but having no induction prevention member 203 between adjacent conductors 201.

Figure 19:
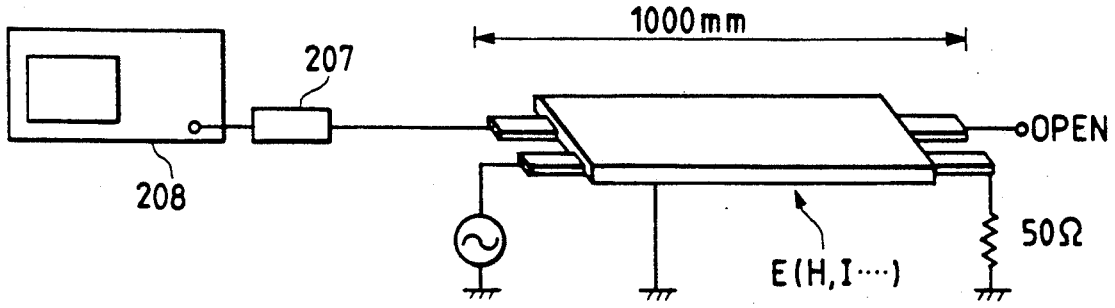
FIG. 19 is a view showing a method of measuring an induction prevention effect.

The induction prevention effects of these cables E, H, I, J and E' at frequency f were measured according to a method shown in FIG. 19. In FIG. 19, reference numeral 207 denotes FET probe, and reference numeral 208 denotes a spectrum analyzer.

The induction prevention effect was calculated by the following formula:

$$S = 20 \log \frac{Vo}{Vm}$$

S: induction prevention effect (dB)

Vo: induced voltage (V) of a tape cable without the electrically-conductive resin or without the metal foil.

Vm: induced voltage (V) of the table cables of Examples and Comparative Example.

Figure 20:
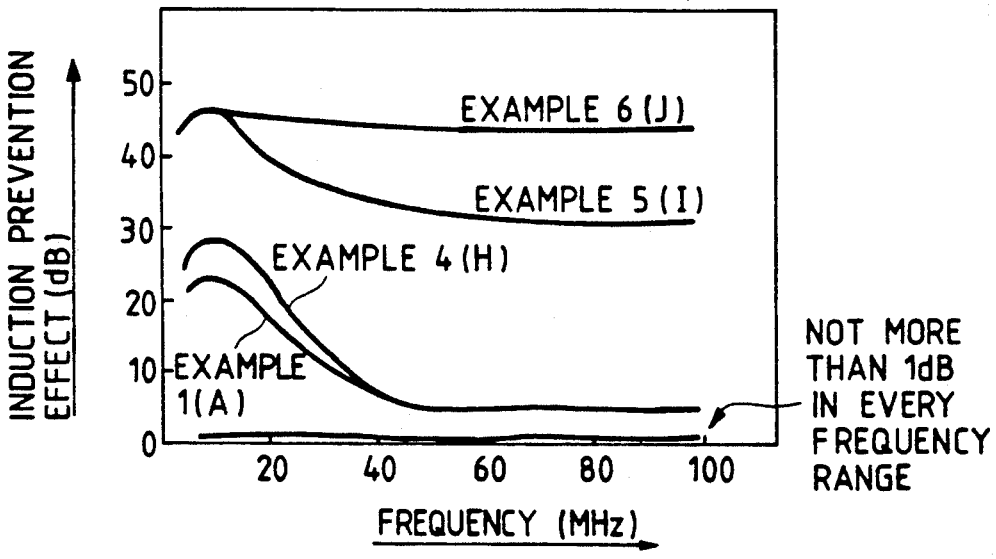
FIG. 20 is a graph showing inter-conductor induction prevention effect of the various tape cables of the present invention.

These measurement results are shown in FIG. 20.

As is clear from FIG. 20, the cables E and H exhibited the inter-conductor induction prevention effect, as compared with the cable E'. With respect to the cable I having the drain wire and the cable J having the drain wire and the metal foil, the effect was markedly improved.

As described above, the tape cable of the present invention, having the induction prevention member between the adjacent conductors, has an excellent interconductor induction prevention effect, and by the use of the electrically-conductive resin having a volume resistivity of $10^{-2}$ to $10^{4}$ Ω·cm, the thin and compact design can be achieved. If the electrical conductivity-imparting material of the electrically-conductivity resin is of the carbon type, the lightweight design and the corrosion resistance can be enhanced.

By the addition of the drain wire and the shield layer, an easy earth connection can be made in addition to the electromagnetic wave shield effect.

What is claimed is:

1. A shielded wire comprising:

a conductor:

an insulation layer provided around an outer periphery of said conductor;

a shielding means for shielding said conductor from electromagnetic interference, said shield means including an electrically-conductive resin layer provided around an outer periphery of said insulation layer;

a covering insulation layer formed around an outer periphery of said electrically-conductive resin layer; and a helically wound drain wire embedded in the inner surface of said electrically conductive resin layer so as to be in electrical contact therewith.

2. A shielded wire as claimed in claim 1, wherein said drain wire has a substantially flat rectangular cross section.

3. A shielded wire as claimed in claim 2, wherein the ratio of the width to the thickness of said drain wire is not less than 1.

4. A shielded wire as claimed in claim 1, wherein said drain wire is spirally wound at least two revolutions per meter.

5. A shielded wire as claimed in claim 1, wherein the ratio of the cross-sectional area of said electrically-conductive resin layer to that of said drain wire satisfies the following condition:

$S_1/S_2 < 1500$ where $S_1$: cross sectional area of said electrically-conductive resin layer;

$S_2$: cross sectional area of said shield means.

6. A shielded wire as claimed in claim 1, wherein said electrically-conductive layer has a volume resistivity of $10^{-3}$ to $10^{5}$ Ω·cm.

7. A shielded wire comprising:

a conductor:

an insulation layer provided around an outer periphery of said conductor;

an electrically-conductive resin layer provided around an outer periphery of said insulation layer;

a covering insulation layer formed around an outer periphery of said electrically-conductive resin layer; and shield means for shielding said conductor from electromagnetic interference, said means formed to electrically contact said electrically-conductive resin layer;

wherein said electrically-conductive layer includes vapor phase-grown carbon fiber and graphitized carbon fiber made of said phase-grown carbon fiber.

8. A shielded wire as claimed in claim 7, wherein said drain wire is spirally wound around said outer periphery of said electrically-conductive resin layer.

9. A shielded wire as claimed in claim 7, wherein said shield means includes drain wire spirally disposed inwardly of said electrically-conductive resin layer.

10. A shield cable comprising:

a conductor;

an electrically-conductive resin layer provided around an outer periphery of said conductor, said electrically-conductive layer having a volume resistivity of $10^{-3}$ to $10^{5}$ Ω·cm, said electrically-conductive layer including vapor phase-growing carbon fiber and graphitized carbon fiber made of said phase-growing carbon fiber; and a covering insulation layer formed around an outer periphery of said electrically-conductive resin layer.

11. A shielded cable comprising:

a plurality of conductors disposed in parallel to each other and separated by a predetermined gap;

an induction prevention member made of an electrically-conductive resin layer provided between any two adjacent ones of said conductors;

a covering insulation member provided to cover said induction prevention member and said conductors and a conductive layer covering said insulation member.

12. A shielded cable as claimed in claim 11, further comprising:

drain wire disposed in said induction prevention member to electrically contact said induction prevention member.

13. A shielded wire as claimed in claim 12, wherein said drain wire electrically contacts said induction prevention member at the central portion of said shield cable in parallel to said conductor.

14. A shielded wire as claimed in claim 12, wherein said drain wire is rectangularly shaped in a cross section.

15. A shielded wire as claimed in claim 14, wherein the ratio of the width to the thickness of said drain wire is not less than 1.

16. A shielded wire as claimed in claim 11, wherein said induction prevention member is provided to cover at least one of upper and lower surfaces of each conductor.

17. A shielded wire as claimed in claim 11, wherein said electrically-conductive layer has a volume resistivity of $10^{-3}$ to $10^{5}$ Ω·cm.

18. A shielded cable comprising:

a plurality of conductors disposed in parallel to each other and separated by a predetermined gap;

an induction prevention member made of an electrically-conductive resin layer provided between any two adjacent ones of said conductors;

a covering insulation member provided to cover said induction prevention member wherein said electrically-conductive layer includes a vapor phase-grown carbon fiber and graphitized carbon fiber made of said phase-grown carbon fiber.

* * * * *